US005158023A

United States Patent [19]

Allen

[11] Patent Number: 5,158,023

[45] Date of Patent: Oct. 27, 1992

[54] SCAFFOLD TABLE FOR SHEET ROCK FINISHERS

[76] Inventor: Tony L. Allen, 1906 Henderson Rd., Ormond Beach, Fla. 32174

[21] Appl. No.: 658,543

[22] Filed: Feb. 21, 1991

[51] Int. Cl.[5] ..... A47B 23/00

[52] U.S. Cl. ..... 108/42; 248/215; 248/238; 182/120

[58] Field of Search ..... 248/238, 215, 214, 237; 182/120, 129; 108/42, 47, 46, 50; 211/70.6

[56] References Cited

U.S. PATENT DOCUMENTS

| | | | |
|---|---|---|---|
| 46,042 | 1/1865 | Wood | 248/238 |
| 791,531 | 6/1905 | Althoff | 248/238 |
| 1,452,182 | 4/1923 | Butrum | 248/238 X |
| 1,894,974 | 1/1933 | Bleckley | 211/70.6 X |
| 2,033,497 | 3/1936 | Victor | 182/129 X |
| 3,145,031 | 8/1964 | Wilkinson | 211/70.6 X |
| 3,693,756 | 9/1972 | Walker et al. | 182/129 |
| 3,904,041 | 9/1975 | Medgebow | 248/215 X |
| 4,340,106 | 7/1982 | Van Horn, II | 248/214 |
| 4,862,994 | 9/1989 | Hughes, Sr. | 248/238 X |

FOREIGN PATENT DOCUMENTS

| | | | |
|---|---|---|---|
| 2128239 | 4/1984 | United Kingdom | 182/120 |

*Primary Examiner*—Peter A. Aschenbrenner
*Attorney, Agent, or Firm*—Arthur G. Yeager

[57] ABSTRACT

A scaffold table for sheet rock finishers includes a horizontal planar base with subtending walls and a spaced apart U-shaped border wall that together define a U-shaped elongate slot sized to cradle wide-bladed masonry tools therein. The table includes a pair of pivotally mounted adjustable length legs having channels on one end to rest against a horizontal scaffold bar. The forward portion of the table includes an elongate hook member to fit over a higher scaffold bar for removably attaching a table thereto. The table base is reinforced from below and includes at least one vertical hole therethrough for cradling of a nail gun or similar power tool.

19 Claims, 4 Drawing Sheets

SCAFFOLD TABLE FOR SHEET ROCK FINISHERS

BACKGROUND OF THE INVENTION

1. Field of the Invention

The present invention relates to tables for temporary attachment to a scaffold and particularly to tables for use in sheet rock finishing and other applications employing a variety of bladed tools.

2. Prior Art

A wide variety of attachment devices for use on window ledges and the like are known to the prior art. None of these, however, are specifically adapted to hold tools and, in particular, those tools used in masonry and related crafts. Tools used in jobs such as sheet rock finishing employ thin and wide moderately flexible metal blades for use with plaster and the like.

What is needed in particular is a table with pivotal, adjustable length legs specifically adapted to fit onto the horizontal members or rungs of a scaffold. Such a table should have means for holding masonry tools and other apparatus and be constructed so that it can be moved upwardly or downwardly on the scaffold rungs while maintaining the tools secured into position so that they will not fall off or become misplaced. None of the window chairs or the like known to the prior art are satisfactory in providing all the features needed and the features especially needed in masonry work with its unique tools.

SUMMARY OF THE INVENTION

In one aspect of the present invention there is provided a table adapted for removable attachment to a scaffold including a planar base having a front portion, a rear edge, and two side edges, the front portion being formed as a hook member for removably attaching the table to a horizontal member of a scaffold, a pair of spaced apart legs having opposite end portions, a channel means attached to one end portion of each leg for engagement with another lower horizontal member of a scaffold, and attachment means connecting another end portion of each leg to the base, and the base further including cradle means for removably mounting a plurality of bladed tools therein.

In other aspects of the invention the cradle means includes at least one wall member spaced away from one edge of the base. Preferably the cradle means includes a first U-shaped wall attached to and extending downwardly from the base along the rear edge and side edges and a second U-shaped wall spaced away from the first wall and defining a slot therebetween, and spacer means for attaching the second wall to the first wall. The spacer means includes a plurality of spacer elements, each element being sized to allow passage of a blade of a masonry tool through the slot and inhibit passage of a handle of such tool therethrough. The second wall is attached to the first wall by the spacer means to position the upper edge of the second wall above the plane of the base to inhibit movement of objects off the base. The hook member includes an elongated wall extending downwardly from the plane of the base.

Further aspects of the invention are seen where the cradle means includes a first U-shaped wall extending downwardly from the rear edge along the length thereof and side edges substantially the length thereof and a second U-shaped wall spaced away from the first wall and defining a U-shaped slot therebetween and spacer means for attaching the second wall to the first wall. The hook member includes an elongated wall extending downwardly from the front edge and an area of the base adjacent thereto, the spacers positioned on the side edges and not on the rear edge so that the portion of the slot adjacent the rear edge is open throughout the length thereof. Each said leg includes adjustable means for varying its length to accommodate for various spaced horizontal members of a scaffold and each such means includes a pair of telescoping elements for selectively adjusting the length thereof and means for releasably securing the pair of elements in position at selected lengths. The attachment means includes pivot means for pivotally mounting each leg to the base. The base has at least on opening formed therethrough which is proportioned to removably secure a portion of a tool placed therein.

BRIEF DESCRIPTION OF THE DRAWINGS

The novel features believed to be characteristic of this invention are set forth with particularity in the appended claims. The invention, itself, however, both as to its organization and method of operation, together with further objects and advantages thereof, may best be understood by reference to the following description taken in connection with the accompanying drawings in which:

DETAILED DESCRIPTION OF THE PREFERRED EMBODIMENT

Figure 1:
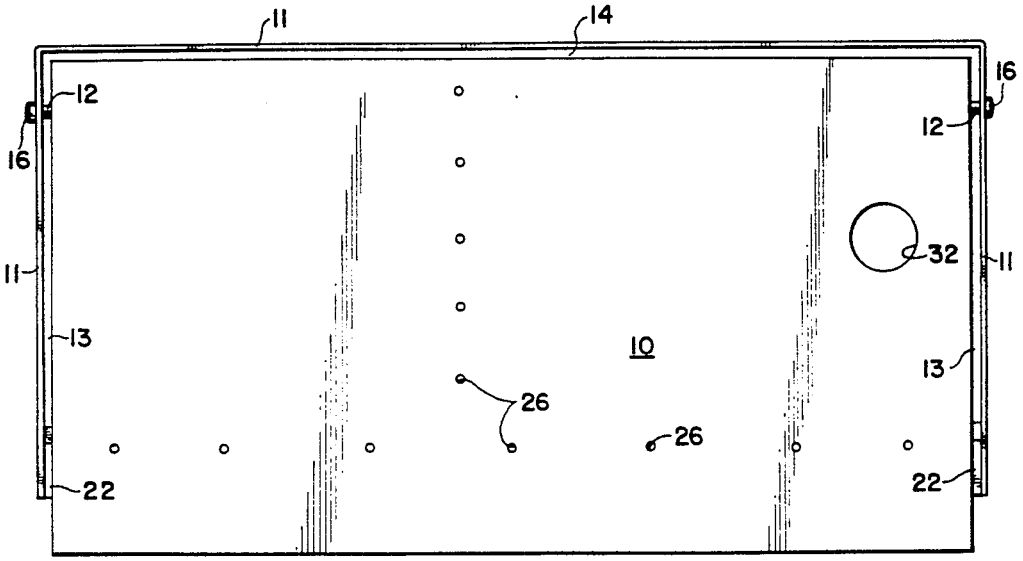
FIG. 1 is a top view of the scaffold table in accord with the present invention.
Figure 2:
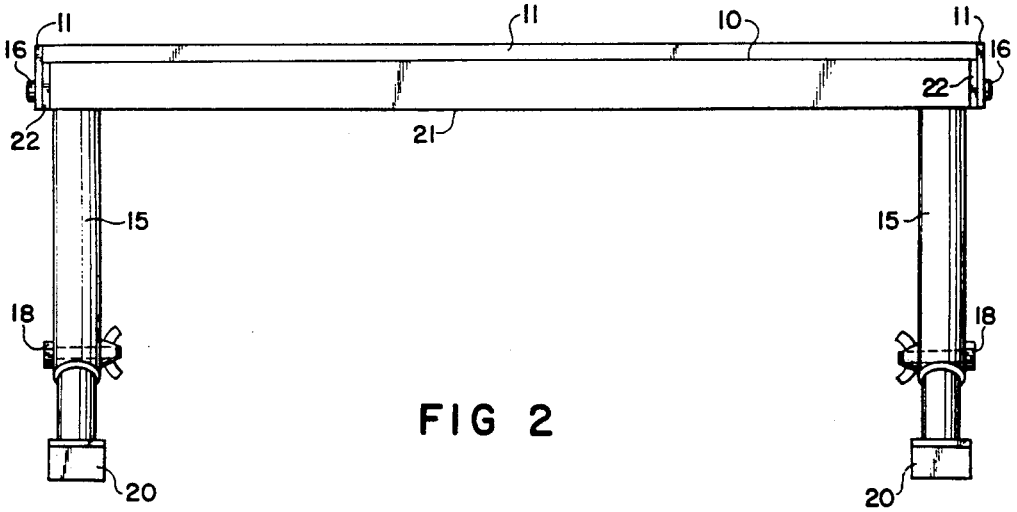
FIG. 2 is a front elevational view of the table shown in FIG. 1.

Referring now to the drawings, the base of the scaffold table or tray is depicted at numeral 10 in FIG. 1 and consists of a planar aluminum sheet generally rectangular in shape. A cradle means for masonry tools includes the U-shaped border wall 11 which extends the length of the rear edge of base 10 and substantially the length of the two side edges. Spacers 12 position wall 11 away from the base 10 a sufficient amount to define an elongate U-shaped slot that can be conveniently divided into two side slots 13 and a rear slot 14 for ease of illustration and discussion. The spacers 12 are sized to provide that the distance between base 10 and wall 11 is sufficient to allow passage of the planar blade therethrough but to prohibit the passage of the body of handle therethrough so that the slots 13, 14 can be used for temporary tool storage. Preferably, spacers 12 are not mounted across slot 14 so that the slot 14 is open its entire length.

Figure 3:
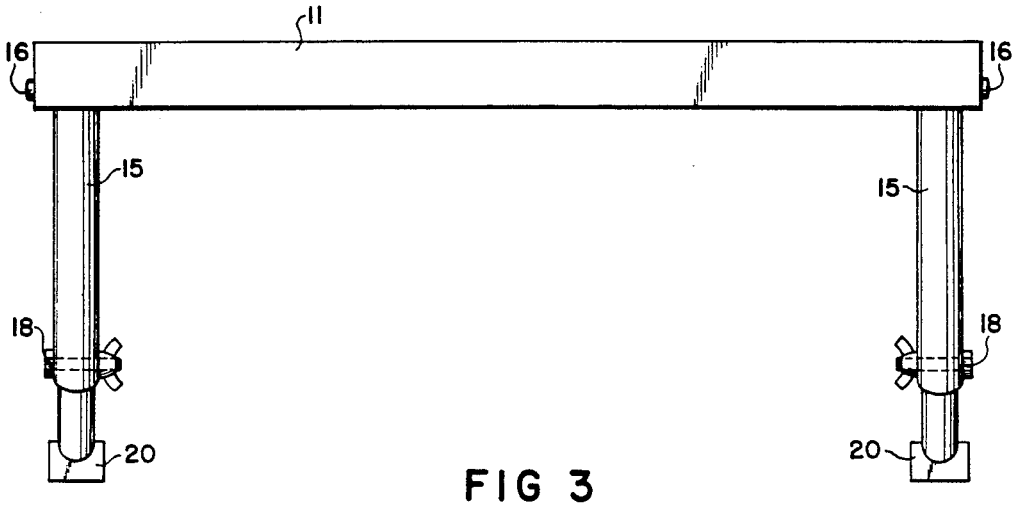
FIG. 3 is a rear elevational view of the table of FIG. 1.
Figure 4:
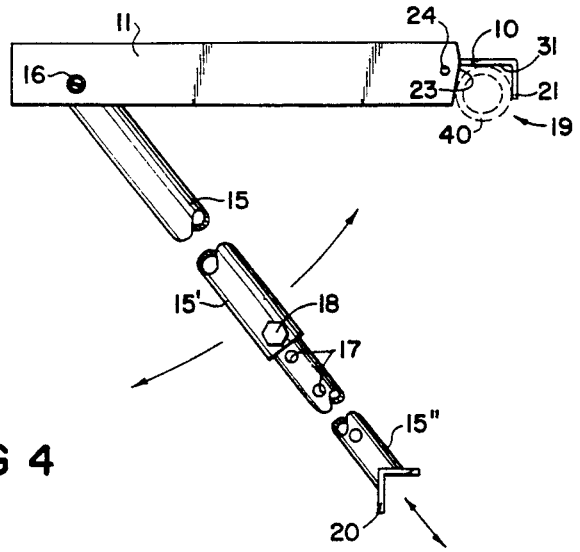
FIG. 4 is a side view of the table in FIG. 1 illustrating the construction of the table legs.

With reference now to FIGS. 3 and 4, the scaffold table also includes a pair of spaced apart telescoping legs 15 constructed of two tubular elements 15', 15'' that are secured into position at a desired length via passageways 17 and bolt 18 as understood in the art. Channels 20 on the ends of legs 15 are sections of angle members welded thereon and adapted to be placed against a scaffold bar member as will be discussed hereinbelow. The other end of each leg 15 is adapted to be pivotally mounted to the table assembly via a pin or rod 16 which preferably is a simple bolt (see also FIG. 5).

Figure 5:
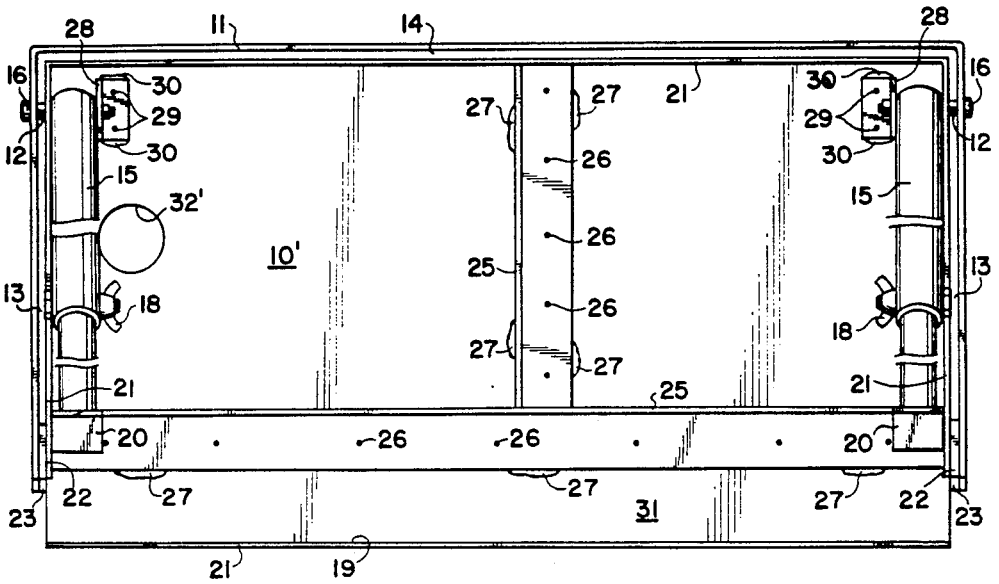
FIG. 5 is a bottom view of the table of FIG. 1.

FIG. 5 is a bottom view of the table assembly illustrating the formation of an elongate hook member 19 defined by the front subtending wall 21 and the adjacent portion 31 of the base 10. The hook member 19 is adapted to fit over a horizontal bar member of a scaffold. As can be seen, the sides of the border wall 11 that run parallel to the side edges of the base 10 extend substantially the length of the edges thereof but terminate adjacent base portion 31 to cooperate with hook member 19. The forward edges 23 of wall 11 are also sloped to fit against the scaffold bar to limit motion of the table when it is attached to the scaffold (see FIG. 4 also). Spacers 22 are used to provide reinforcement and are sized to define the transverse distance across the side slots 13 as are spacers 12.

The walls 21 that subtend downwardly from the edges of the base 10 are preferably formed, with base 10, from a single piece of aluminum as understood in the art. This construction provides a structure to which border wall 11 and legs 15 can be attached via rivets 24 and pivot rods 16 respectively and also provides that slots 13 and 14 have planar walls to secure a flat-bladed masonry tool therein.

FIG. 5 also illustrates many of the construction details of the scaffold table. Bottom framing members 25 are welded and riveted into place on bottom surface 10' via welds 27 and rivets 26. The members 25 provide strength so that base 10 can support paint and plaster cans and the like. Pivot rod 16 is mounted onto bracket 28 via rivets 29 and welds 30. The passageway 32 is cut into base 10 and is sized to house a power tool such as a drill or nail gun. It is to be understood that more than one passageway can be formed in the base 10 as appropriate in the circumstances.

Figure 6:
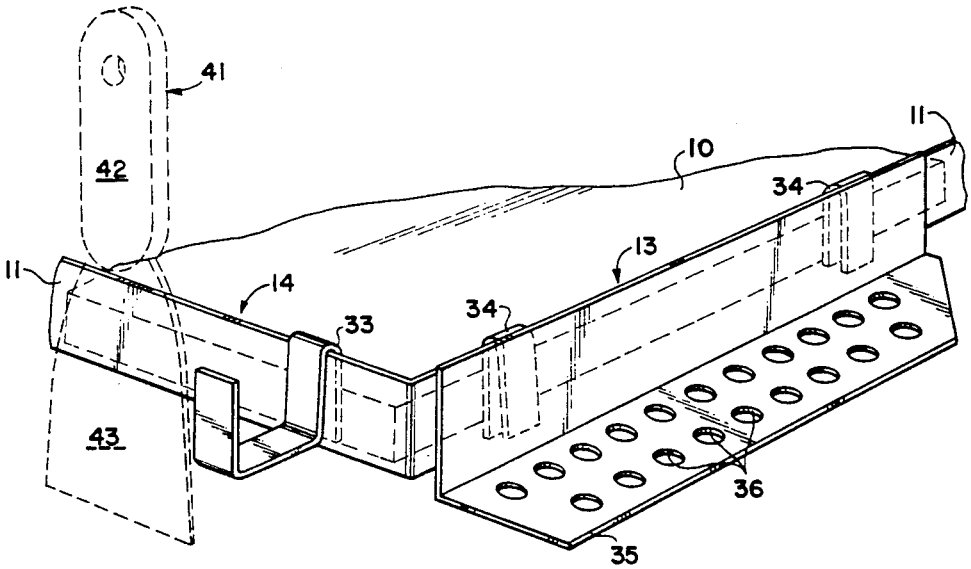
FIG. 6 is a perspective view of part of the table illustrating the placement of attachments to the table.

FIG. 6 illustrates the use of slots 13 and 14 for the mounting of brackets 33 and 34 which support additional apparatus such as shelf 35 having a plurality of holes 36 formed therethrough for holding a wide variety of tools therein. A standard masonry tool 41 includes a handle 42 and a thin and wide blade 43.

Figure 7:
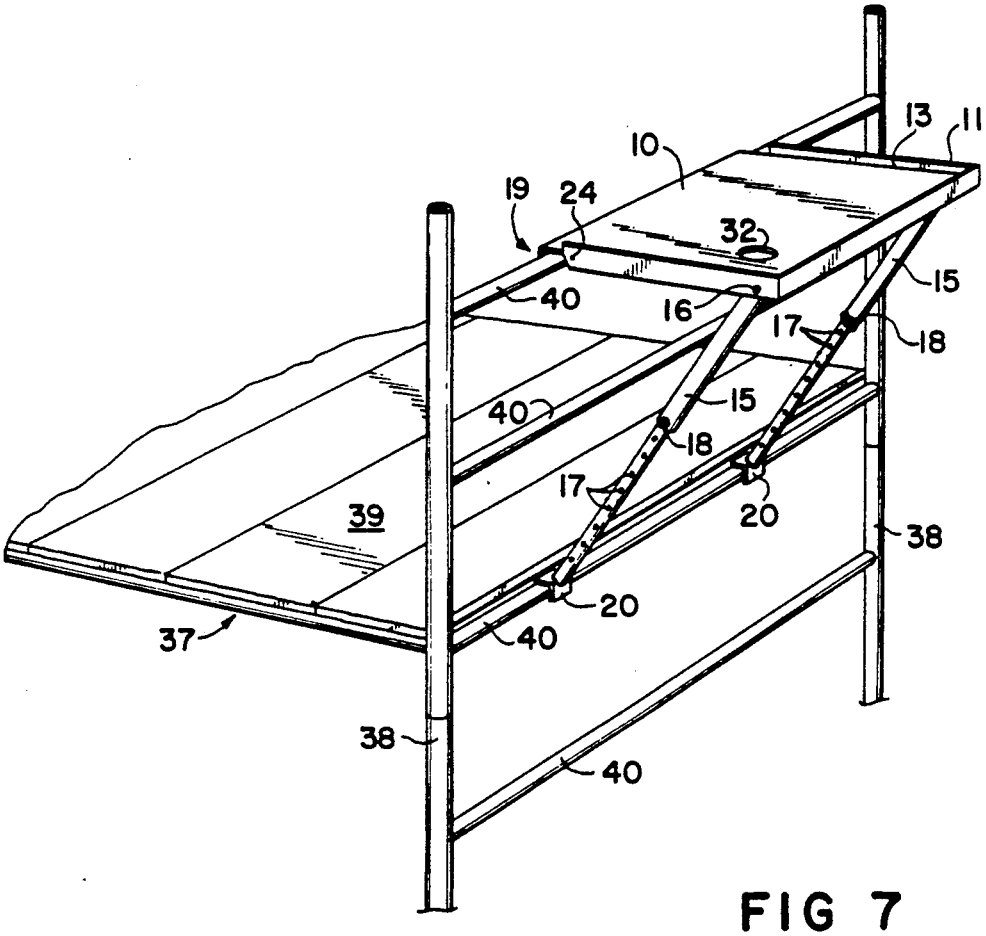
FIG. 7 is a perspective view of the table of FIG. 1 in use as mounted onto the rungs of a scaffold.

FIG. 7 illustrates a standard scaffold 37 having upright posts 38 and a deck 39. Transverse bar members 40 are welded to posts 38 as understood in the art. The table is mounted by placing leg channels 20 against a bar 40 and placing hook member 19 over another bar 40 as illustrated. Legs 15 are adjustable in length to accomodate different scaffold dimensions.

Border wall 11 is attached to the base 10 in a manner to provide that the upper edge of the wall is above the horizontal plane of the base 10. This arrangement inhibits the accidental movement of the cans or tools off the base surface. In addition, spacers 12 and 23 are placed only on the sides of the table 10 so that rear slot 14 is open along its entire length so as to accomodate tools 41 that have an extremely wide blade 43. The distance across the slots 13 and 14 is such that a blade 43 will fit therethrough through but a handle 42 will not.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A table adapted for removable attachment to a scaffold comprising a planar base having a front portion with a forward edge, a rear edge, and two side edges, said front portion including a hook member adjacent said forward edge for removably attaching said table to a horizontal member of a scaffold, a pair of spaced apart legs having opposite end portions, a channel means attached to one said end portion of each said leg for engagement with another lower horizontal member of a scaffold in substantial vertical alignment with a horizontal member of a scaffold which is adapted for attachment of said hook member, and attachment means connecting another said end portion of each said leg to said base adjacent said rear edge, and said base further including cradle means for removably mounting a plurality of bladed tools therein, said cradle means including at least one U-shaped wall member spaced away from and extending substantially the length of said rear edge of said base to provide an elongated slot between said wall member and said rear edge of said base into which blades of bladed tools may be inserted, said U-shaped wall member having end portions extending along and spaced from said side edges for providing side slots into which blades of bladed tools may be inserted.

2. The table as defined in claim 1 wherein said cradle means includes another U-shaped wall member attached to and extending downwardly from said base along said rear edge and side edges, said U-shaped wall member being spaced away from said another wall member and defining said elongated slot and said side slots therebetween, and spacer means for attaching said wall member to said another wall member.

3. The table as defined in claim 2 wherein said spacer means includes a plurality of spacer elements, each said element being sized to allow passage of a blade of a masonry tool through said slot and inhibit passage of a handle of such tool therethrough.

4. The table as defined in claim 2 wherein said second wall member is attached to said first wall member by said spacer means to position the upper edge of said second wall member above the plane of said base to inhibit movement of objects off said base.

5. The table as defined in claim 1 wherein said hook member includes an elongated wall extending downwardly from the plane of said base.

6. The table as defined in claim 1 wherein said cradle means includes a first U-shaped wall member extending downwardly from said rear edge along the length thereof and side edges substantially the length thereof and a second U-shaped wall member spaced away from said first wall member and defining a U-shaped slot therebetween and spacer means for attaching said second wall member to said first wall, said hook member includes an elongated wall extending downwardly from said front edge and an area of said base adjacent thereto, said spacers positioned on said side edges and not on said rear edge so that said portion of said slot adjacent said rear edge is open throughout the length thereof.

7. The table as defined in claim 1 wherein each said leg includes adjustable means for varying its length to accommodate for various spaced horizontal members of a scaffold.

8. The table as defined in claim 7 wherein each said adjustable means includes a pair of telescoping elements for selectively adjusting the length thereof and means for releasably securing said pair of elements in position at selected lengths.

9. The table as defined in claim 1 wherein said attachment means includes pivot means for pivotally mounting each said leg to said base.

10. The table as defined in claim 1 wherein said base has at least one opening formed therethrough, said opening proportioned to removably secure a portion of a tool placed therein.

11. A table adapted for removable attachment to a scaffold comprising:

a planar base having a front edge, a rear edge and two side edges and including a first wall subtending downwardly substantially along said rear and side edges and terminating short of said front edge and a second wall subtending downwardly from said front edge, a U-shaped border wall, means for attaching said border wall to and spaced away from said base to be closely adjacent said first wall and to define an elongate U-shaped slot between said border wall and said first wall, said second wall and a portion of said base adjacent thereto being engagable with a horizontally disposed bar member of a scaffold by placement of said second wall and said portion of said base over a bar member, and a pair of elongated spaced legs each having opposite end portions, means for attaching one said end portion of each said leg to said base, another said end portion of each said leg being formed as a channel for removably mounting said leg to another lower bar member of a scaffold.

12. The table as defined in claim 11 wherein each said leg includes a pair of elements for selectively adjusting the length thereof and means for securing said pair of elements in position for selected lengths.

13. The table as defined in claim 11 wherein said border wall is attached to said housing in a manner such that said slot is spaced away from said first wall a distance to inhibit passage of a handle of a masonry tool therethrough.

14. The table as defined in claim 11 wherein said means for attaching said border wall to said housing includes a plurality of spacers positioned in said slot for defining the distance between said border wall and said first wall, said distance being proportioned to prevent passage of a masonry tool handle therethrough.

15. The table as defined in claim 11 wherein said border wall is attached to said housing by said means to position the upper edge of said border wall above the plane of said base to inhibit movement of objects off said base.

16. The table as defined in claim 11 wherein said means for attaching one said end portion of each said leg to said base includes pivotal means.

17. The table as defined in claim 11 wherein the end of the portions of said first wall subtending downwardly from each respective said side edge are adapted to fit against a bar member of a scaffold when said hook member is placed over such bar.

18. A removable tray for mounting to a scaffold comprising:

a rectangular planar base with depending front, back and side walls, said side walls being discontinuous adjacent said front wall to accomodate a horizontal member of a scaffold beneath said base with said front wall engaged against a horizontal member of a scaffold, a continuous border wall extending along and spaced from side and rear walls, spacer means positioned between said border wall and said side walls to maintain said border wall in appropriate spaced relation thereabout, said border wall extending upwardly above a plane of said base, a pair of elongated spaced and extensible legs connected to said base adjacent respective side walls, a pair of pivot means passing through said border and side walls and said spacer means for attaching respective upper ends of said legs to said side walls, lower ends of said legs carrying respective angles for accommodating a lower horizontal member of a scaffold.

19. The table as defined in claim 18 wherein said spacer means are positioned between said border wall and said side walls to define the space between said border wall and said side walls as side slots and to define the space between said border wall and said rear wall as a rear slot open the entire length thereof, said spacer means being sized to define the distance across said slot to prevent the passage of a bladed tool therethrough.

* * * * *